US009389559B2

(12) United States Patent
Uehara et al.

(10) Patent No.: US 9,389,559 B2
(45) Date of Patent: Jul. 12, 2016

(54) FIXING DEVICE AND IMAGE FORMING APPARATUS

(71) Applicant: KYOCERA Document Solutions Inc., Osaka (JP)

(72) Inventors: Masakazu Uehara, Osaka (JP); Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/677,224

(22) Filed: Apr. 2, 2015

(65) Prior Publication Data

US 2015/0301486 A1 Oct. 22, 2015

(30) Foreign Application Priority Data

Apr. 18, 2014 (JP) ..... 2014-086305

(51) Int. Cl.
*G03G 15/20* (2006.01)

(52) U.S. Cl.
CPC ..... *G03G 15/2064* (2013.01); *G03G 15/2017* (2013.01)

(58) Field of Classification Search
CPC ..... G03G 15/2064; G03G 15/2017
USPC ..... 399/328
See application file for complete search history.

(56) References Cited

U.S. PATENT DOCUMENTS 5,481,347 A * 1/1996 Adachi ..... G03G 15/2064 219/216
6,549,740 B2 * 4/2003 Yoneda ..... G03G 15/2064 399/122
8,488,990 B2 * 7/2013 Sato ..... G03G 21/1619 399/107
2010/0028036 A1 * 2/2010 Aratachi ..... G03G 15/2039 399/69

FOREIGN PATENT DOCUMENTS

JP 2002-229363 A 8/2002

* cited by examiner

*Primary Examiner* — David Gray
*Assistant Examiner* — Tyler Hardman
(74) *Attorney, Agent, or Firm* — Studebaker & Brackett PC

(57) ABSTRACT

A fixing device includes a heating roller and a pressuring roller, a first holding member, a supporting member and a temperature detecting part. The heating roller and pressuring roller sandwiches and heats a sheet to fix a toner image formed on the sheet onto the sheet. The first holding member has a facing part facing to a circumference face of the heating roller to hold the heating roller. The supporting member is made of material with high heat resisting property as compared with the first holding member, arranged between the facing part of the first holding member and the circumference face of the heating roller so as to face to the circumference face of the heating roller, and formed in an elongated shape along an axial direction of the heating roller. The temperature detecting part is arranged in the supporting member to detect temperature of the heating roller.

8 Claims, 10 Drawing Sheets

FIXING DEVICE AND IMAGE FORMING APPARATUS

INCORPORATION BY REFERENCE

This application is based on and claims the benefit of priority from Japanese Patent application No. 2014-086305 filed on Apr. 18, 2014, the entire contents of which are incorporated herein by reference.

BACKGROUND

The present disclosure relates to a fixing device fixing a toner image, which is formed on a recording paper, onto the recording paper and an image forming apparatus including the fixing device.

An image forming apparatus, such as a copying machine, a printer, a facsimile and a multifunction peripheral having each function of these devices, including an electrophotographic printing mechanism is provided with a fixing device. The fixing device includes a heating roller having a surface heated by a heat source and a pressuring roller having a rotation shaft arranged in parallel with a rotation shaft of the heating roller. When a sheet having a surface, on which a toner image is formed, is passed through the fixing device, the sheet is sandwiched between the heating roller and pressuring roller by a predetermined pressure and heated. Thereby, a toner is molten to the sheet and an image is fixed onto the sheet.

This kind of fixing device generally includes a temperature detecting element, such as a thermistor detecting circumference face temperature of the heating roller, and a temperature adjusting element, such as a thermal cut adjusting supply and interruption of electric power to a heater built in the heating roller. These elements are used to control the circumference face temperature of the heating roller.

The fixing device may include an exterior case made by synthetic resins. The exterior case has a first casing holding the heating roller and a second casing holding the pressuring roller. The temperature detecting element may be arranged at a predetermined position on an inner wall face in a situation of facing to a circumference face of the heating roller at a prescribed distance.

However, the exterior case is made by synthetic resins as mentioned above. Because of this, the exterior case, particularly the first casing holding the heating roller, may be deformed by receiving heat generated from the heating roller. When the first casing is deformed, the distance between the temperature detecting element arranged in the first casing and the circumference face of the heating roller is varied. In order to suitably control the circumference face temperature of the heating roller, the distance between the temperature detecting element and heating roller is important. However, if the distance is varied as mentioned above, the circumference face temperature of the heating roller cannot correctly be detected. As a result, it is impossible to suitably control the circumference face temperature of the heating roller.

SUMMARY

In accordance with one aspect of the present disclosure, a fixing device includes a heating roller and a pressuring roller, a first holding member, a supporting member and a temperature detecting part. The heating roller and pressuring roller sandwiches and heats a sheet to fix a toner image formed on the sheet onto the sheet. The first holding member has a facing part facing to a circumference face of the heating roller to hold the heating roller. The supporting member is made of material with high heat resisting property as compared with the first holding member, arranged between the facing part of the first holding member and the circumference face of the heating roller so as to face to the circumference face of the heating roller, and formed in an elongated shape along an axial direction of the heating roller. The temperature detecting part is arranged in the supporting member to detect temperature of the heating roller.

In accordance with another aspect of the present disclosure, an image forming apparatus includes the fixing device as mentioned above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the drawings, an embodiment of the present disclosure will be described. The embodiment described as followed is an example concreated the present disclosure, but does not limit the technical range of the present disclosure.

Figure 1:
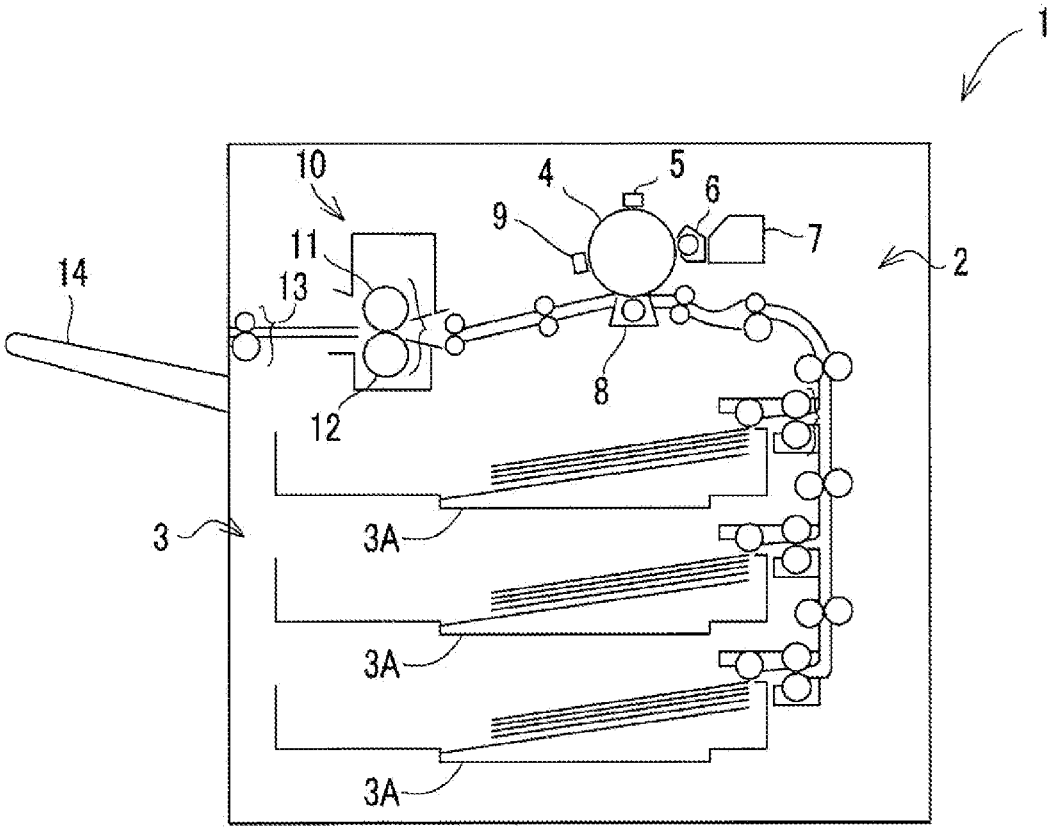
FIG. 1 is a schematic diagram showing a structure of an image forming apparatus in accordance with an embodiment of the present disclosure.

First, a structure of an image forming apparatus 1 according to the embodiment of the present disclosure will be described. The image forming apparatus 1 is a printer, which includes, as shown in FIG. 1, an image forming part 2 and a sheet feeding part 3. As other examples of the image forming apparatus according to the present disclosure, there are image forming apparatuses, such as a facsimile, a copying machine and a multifunction peripheral.

As shown in FIG. 1, the image forming part 2 carries out image forming in an electrophotographic manner executing an image forming process (a printing process) on the basis of a print job inputted from an external information processing device, such as a personal computer. Concretely, the image forming part 2 includes a photosensitive drum 4, a charging part 5, a developing part 6, a toner container 7, a transferring roller 8, a discharging part 9, a fixing device 10 and others. Incidentally, in the embodiment, the electrophotographic image forming part 2 is described as an example, but the image forming part 2 is not restricted by that in the electrophotographic manner, the image forming part 2 may be actualized in an inkjet recording manner, or alternatively, in another recording manner or another printing manner.

In the image forming part 2, the image forming process to a sheet fed from the sheet feeding part 3 is carried out as a following procedure. First, when the print job with print indication is inputted from the external device, the photosensitive drum 4 is electrically charged at a predetermined electrical potential evenly by the charging part 5. A surface of the photosensitive drum 4 is irradiated with a light based on image data contained in the print job by a laser scanning unit (not shown). Thereby, an electrostatic latent image is formed onto the surface of the photosensitive drum 4. The electrostatic latent image on the photosensitive drum 4 is developed (visualized) as a toner image by the developing part 6. Incidentally, into the developing part 6, a toner (a developer) is replenished from the toner container 7. The toner image formed onto the photosensitive drum 4 is transferred onto the sheet by the transferring roller 8. The electrical potential of the photosensitive drum 4 is discharged by the discharging part 9. Subsequently, the toner image transferred onto the sheet is heated to be molten and fixed, when the sheet is passed through the fixing device 10 and ejected.

The sheet feeding part 3 includes a plurality of attachable/detachable sheet feeding cartridges 3A to feed the sheet stored in each sheet feeding cartridge 3A to the image forming part 2.

The fixing device 10 is configured to sandwich the sheet and to heat the toner image transferred onto the sheet, thereby melting and fixing the toner image. The fixing device 10 includes a heating roller 11 and a pressuring roller 12. The sheet with the toner image fixed by the fixing device 10 is ejected to an ejection tray 14 by a pair of ejecting rollers 13.

Next, with reference to FIGS. 2-11, a detail structure of the fixing device 10 will be described.

Figure 2A:
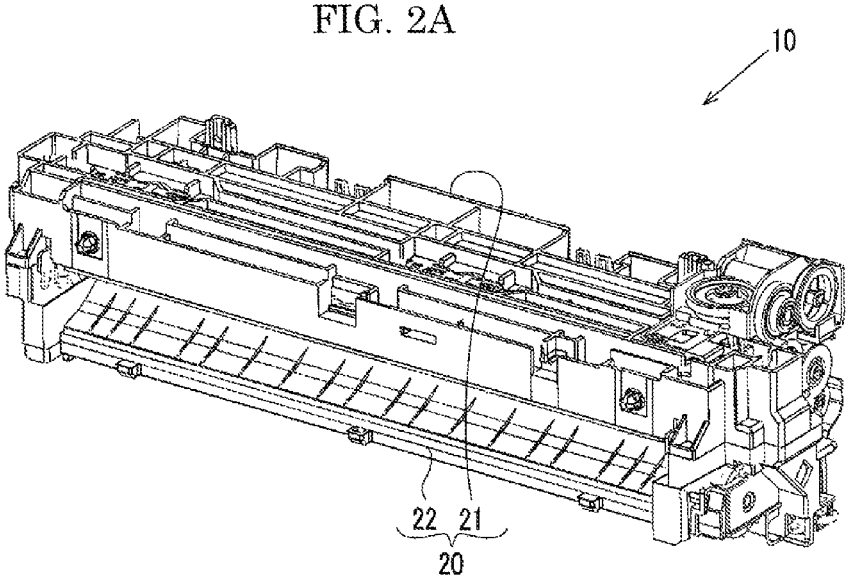
FIG. 2A is a perspective view showing a fixing device arranged in the image forming apparatus shown in FIG. 1.
Figure 2B:
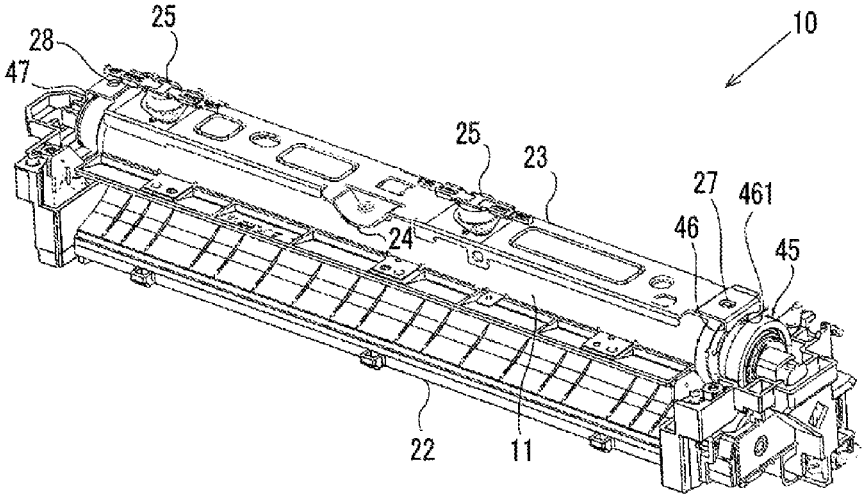
FIG. 2B is a perspective view showing the fixing device shown in FIG. 2A, in a situation where an upper housing is detached.

As shown in FIGS. 2A and 2B, the fixing device 10 has a casing 20. The heating roller 11 and pressuring roller 12 is arranged inside the casing 20. The casing 20 has an upper housing 21 and a lower housing 22. The heating roller 11 is stored and held inside the upper housing 21. The pressuring roller 12 is stored and rotatably held inside the lower housing 22. The upper housing 21 and lower housing 22 are made of, for example, synthetic resins, such as polyethylene terephthalate (PET). The upper housing 21 is one example of a first holding member of the present disclosure and the lower housing 22 is one example of a second holding member of the present disclosure.

As shown in FIG. 2B, the fixing device 10 includes a supporting plate 23. When the upper housing 21 is detached from the fixing device 10, the supporting plate 23 is exposed at a position above the heating roller 11. The supporting plate 23 is made of material with high heat resisting property (material hardly thermally deformed) as compared with the casing 20. In the embodiment, the supporting plate 23 is composed of a plate metal. The supporting plate 23 is arranged between the heating roller 11 and upper housing 21 as described below in detail. The supporting plate 23 is one example of a supporting member of the present disclosure.

Figure 3:
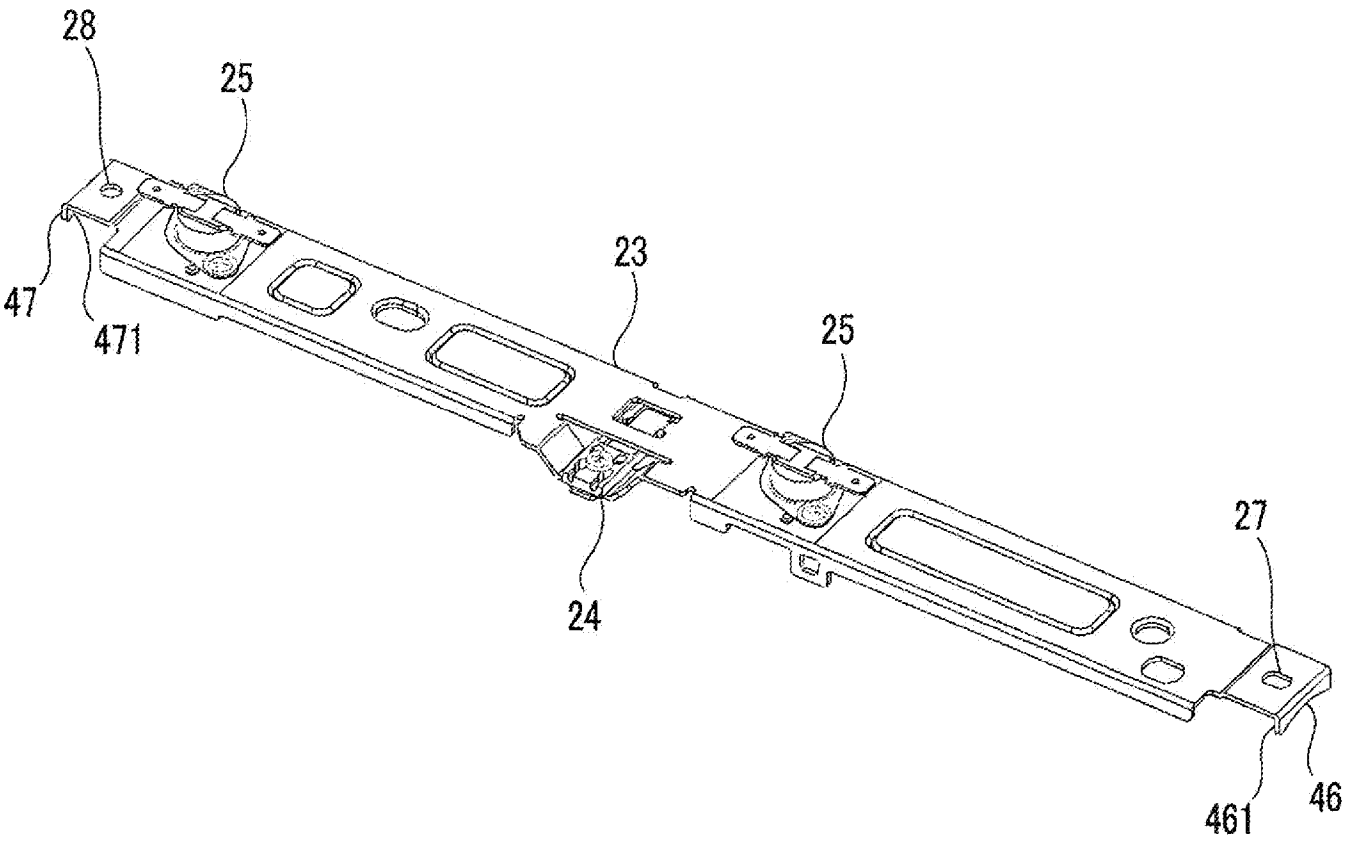
FIG. 3 is a perspective view showing a single supporting plate arranged in the fixing device shown in FIG. 2A.

As shown in FIGS. 2B and 3, the supporting plate 23 has an elongated shape along an axial direction of the heating roller 11. To the supporting plate 23, a thermistor 24 and thermal cuts 25 (temperature adjusting elements) are attached. The thermistor 24 is arranged at a roughly center position in a longitudinal direction of the supporting plate 23. The thermal cuts 25 are respectively arranged at a position near the thermistor 24 and at one end part of the supporting plate 23.

The thermistor 24 detects temperature of a circumference face of the heating roller 11 in a noncontact state. Each thermal cut 25 has a thermistor (not shown) similar to the thermistor 24 so as to cut off power supply to a heater (not shown) arranged in the heating roller 11 when a detecting value of this thermistor is a predetermined value or more. The thermistor 24 and thermal cuts 25 may be well-known those. Therefore, the description of structures and others of those is omitted. In the embodiment, at least the thermistor 24 and thermistors arranged in the thermal cuts are arranged in a face of the supporting plate 23 facing to the circumference face of the heating roller 11. The thermistor 24 and thermistors arranged in the thermal cuts 25 are examples of a temperature detecting part of the present disclosure. In the following description, the thermistor 24 and thermal cuts 25 may be called together as a temperature detecting element. The thermal cuts 25 are examples of an excessive temperature rise preventing device.

Figure 4A:
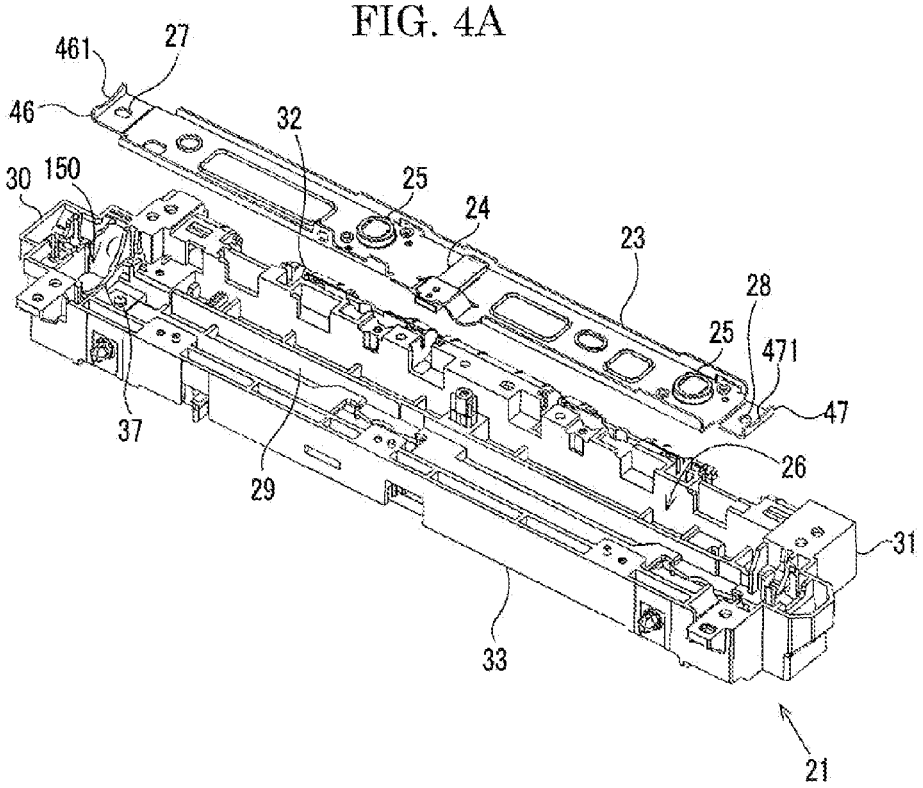
FIG. 4A is a perspective exploded view showing the upper housing, in a situation before the supporting plate shown in FIG. 3 is fitted, as viewed from a lower side.
Figure 4B:
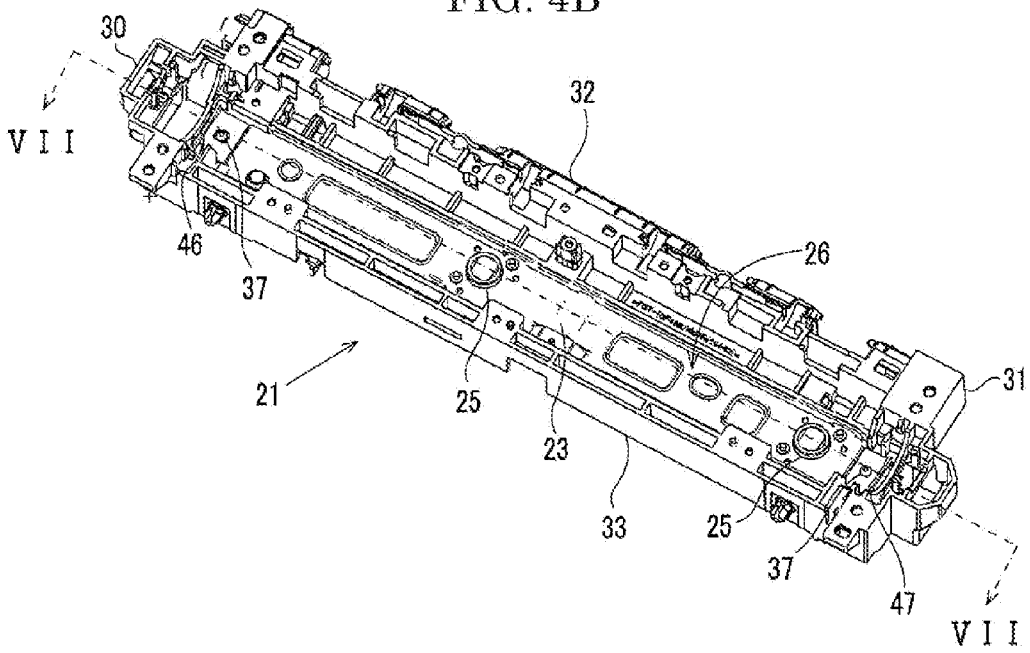
FIG. 4B is a perspective view showing the upper housing, in a situation after the supporting plate is fitted, as viewed from the lower side.

As shown in FIGS. 4A and 4B, the supporting plate 23 is fitted into a recessed part 26 formed in the upper housing 21. Concretely, as shown in FIG. 4A, the upper housing 21 has a facing part 29, a first lateral wall part 30, a second lateral wall part 31, a third lateral wall part 32 and a fourth lateral wall part 33. The facing part 29 is extended along the longitudinal direction of the heating roller 11 to face to the circumference face of the heating roller 11. The facing part 29 constitutes an upper part of the casing 20. The first lateral wall part 30 is erected from the facing part 29 so as to face to one end part of the heating roller 11. The second lateral wall part 31 is erected from the facing part 29 so as to face to another end part of the heating roller 11. The third lateral wall part 32 and fourth lateral wall part 33 are erected from the facing part 29 so as to be extended along the longitudinal direction of the heating roller 11 in states facing to the circumference face of the heating roller 11. By these parts 29-33, the above-mentioned recessed part 26 is formed. Incidentally, FIGS. 4A and 4B show the upper housing 21 of FIG. 2 turned upside down.

As shown in FIGS. 4A and 4B, in an inner wall face of the facing part 29 of the upper housing 21, positioning bosses 37 are formed. The positioning bosses 37 are formed at a predetermined position near the first lateral wall part 30 and at a predetermined position near the second lateral wall part 31 in the inner wall face. Incidentally, in FIG. 4A, only the positioning boss 37 formed at the position neat the first lateral wall part 30 is shown. As shown in FIG. 4A, the supporting plate 23 has hole parts 27 and 28. The hole parts 27 and 28 are formed at predetermined positions neat both end parts in the longitudinal direction of the supporting plate 23. As shown in FIG. 4B, the positioning bosses 37 formed in the facing part 29 of the upper housing 21 are fitted into the hole parts 27 and 28 of the supporting plate 23. Thereby, positioning in the longitudinal direction of the supporting plate 23 to the upper housing 21 is determined. The positioning bosses 37 are examples of a first protruding part of the present disclosure. When the supporting plate 23 is fitted into the recessed part 26 in a state that the positioning bosses 37 are fitted into the hole parts 27 and 28, the supporting plate 23 faces to the inner wall face of the facing part 29 of the upper housing 21. In this time, as shown in FIGS. 7A, 8A and 8B, the supporting plate 23 comes into contact with the upper housing 21 at the periphery of the hole parts 27 and 28.

Figure 7:
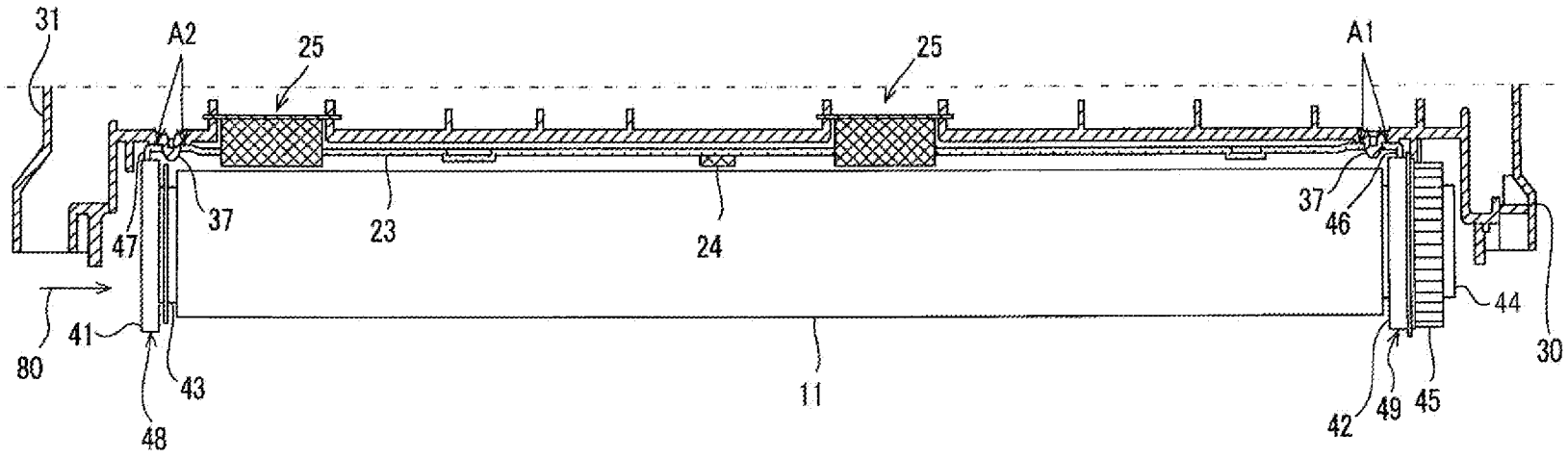
FIG. 7 is a sectional view showing the upper housing as viewed along a chain line allow VII-VII of FIG. 4B.
Figure 8A:
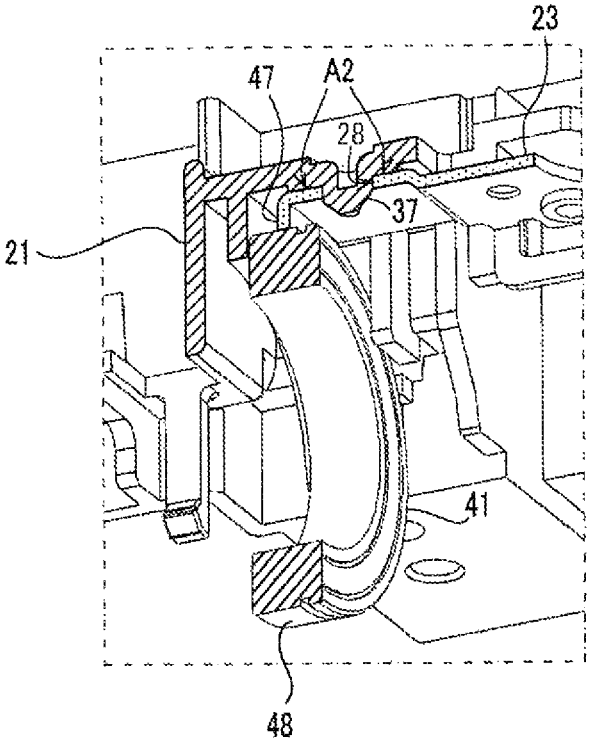
FIG. 8A is a perspective sectional view showing one bearing and its periphery.
Figure 8B:
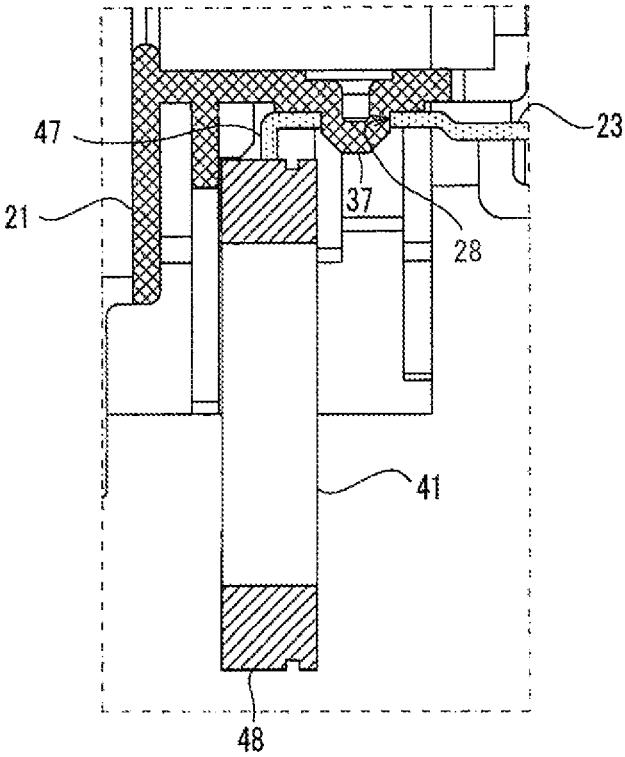
FIG. 8B is a sectional view showing one bearing and its periphery.

As shown in FIG. 7, the heating roller 11 is stored inside the recessed part 26. Concretely, the heating roller 11 is stored inside the recessed part 26 in a state that the supporting plate 23 is fitted into the recessed part 26 as mentioned above.

Figure 5:
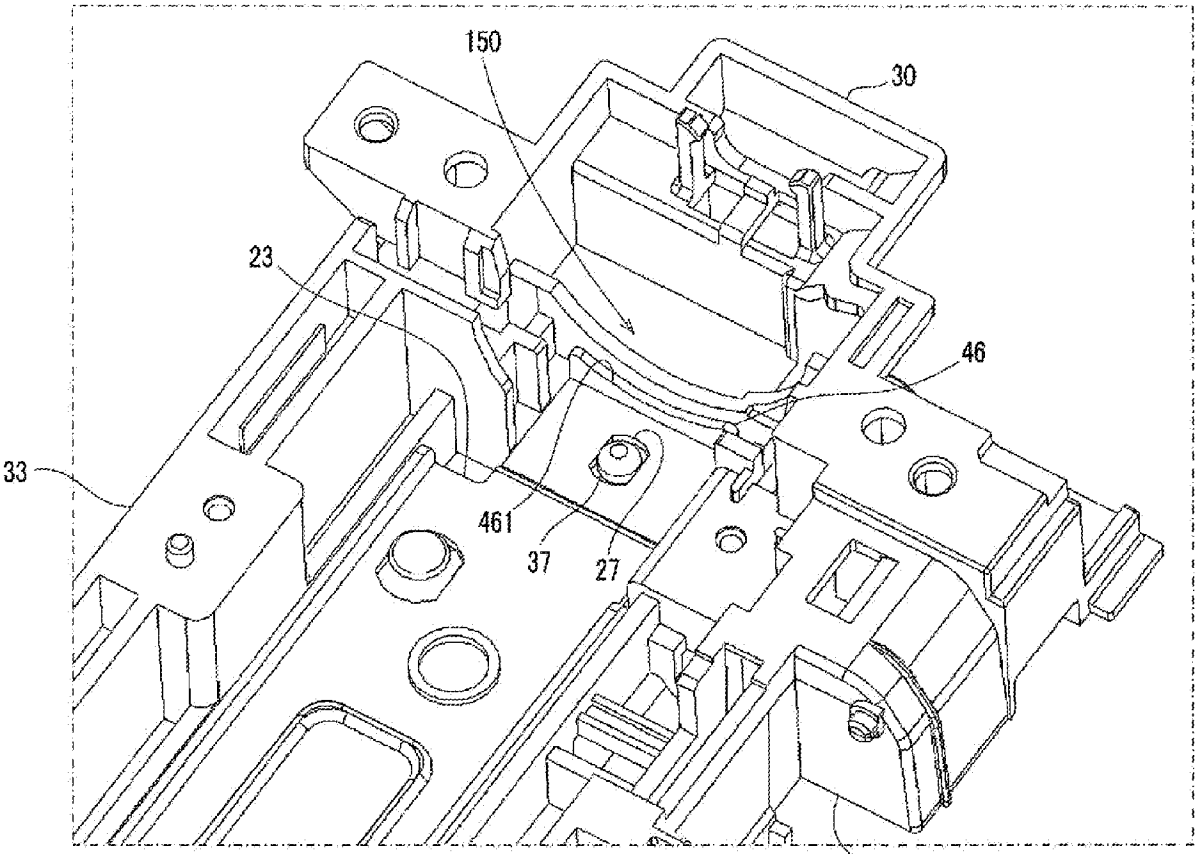
FIG. 5 is an enlarged view showing a structure of one end side of a unit having the upper housing, in which the supporting plate is fitted, as viewed from the lower side.
Figure 6:
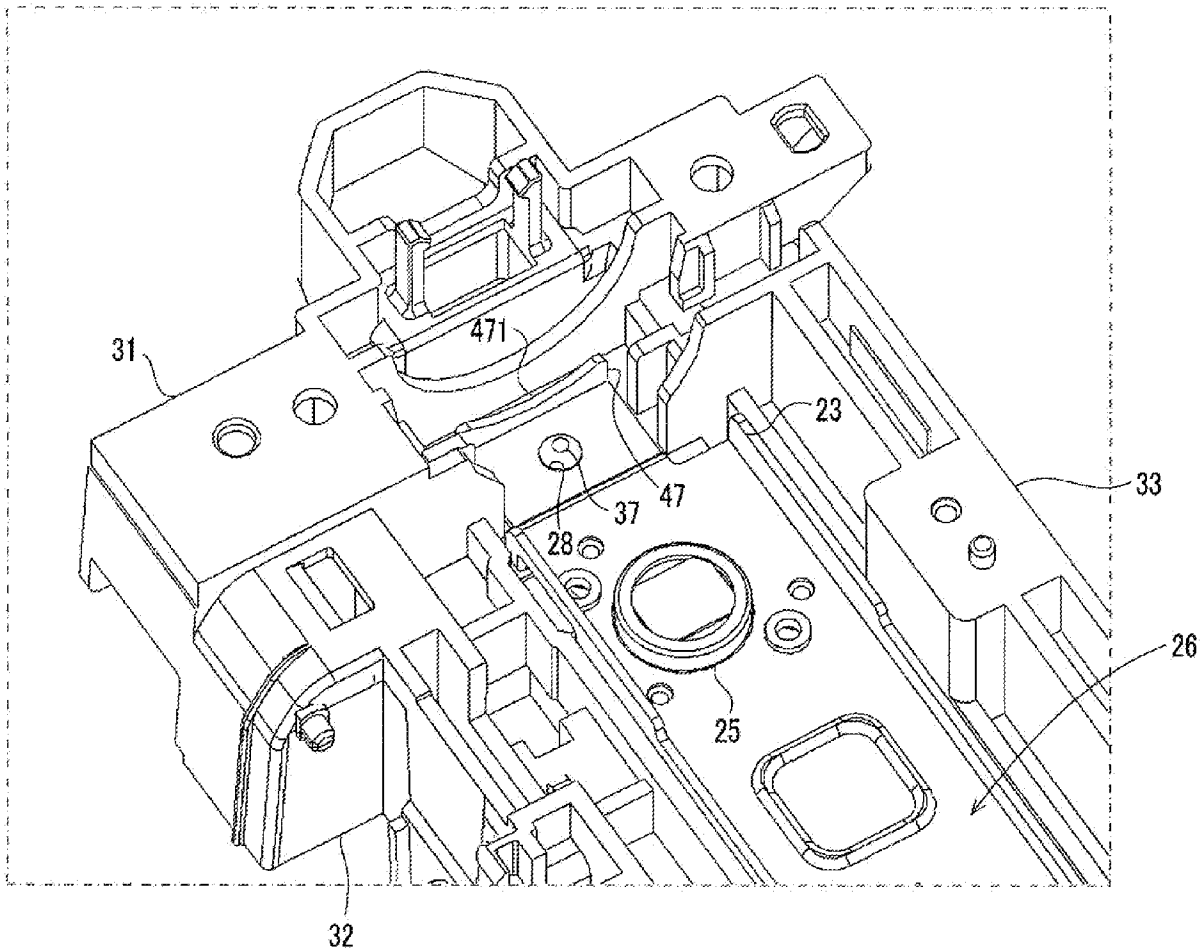
FIG. 6 is an enlarged view showing a structure of another end side of the unit having the upper housing, in which the supporting plate is fitted, as viewed from the lower side.

At both end sides of the heating roller 11, bearings 41 and 42 are arranged. The bearing 41 rotatably supports a rotation shaft 43 arranged at one end part of the heating roller 11. The bearing 42 rotatably supports a rotation shaft 44 arranged at another end part of the heating roller 11. The bearings 41 and 42 are, for example, constituted by well-known ball bearings and have outer circumference faces 48 and 49 with circular shapes as viewed from axial directions of the rotation shafts 43 and 44. When the heating roller 11, in which the bearings 41 and 42 are attached to the rotation shaft 43 and 44, is fitted into the recessed part 26, the bearings 41 and 42 come into contact with the supporting plate 23 positioned to the facing part 29 of the upper housing 21. Concretely, as shown in FIGS. 4A and 5-7, in both ends of the supporting plate 23, bent parts 46 and 47 are formed. The bent parts 46 and 47 are parts bent to a side of the heating roller 11 from a plate-like part facing to the circumference face of the heating roller 11. As shown in FIG. 5, a distal end 461 of the bent part 46 is formed in a curved shape. Similarly, as shown in FIG. 6, a distal end 471 of the bent part 47 is formed in a curved shape.

Figure 9A:
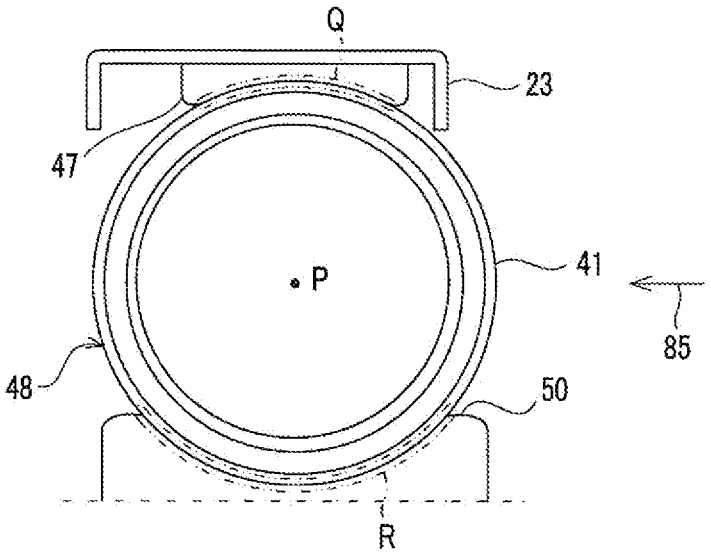
FIG. 9A is a schematic diagram showing a supporting structure of the bearing as viewed along an arrow 80 of FIG. 7.
Figure 9B:
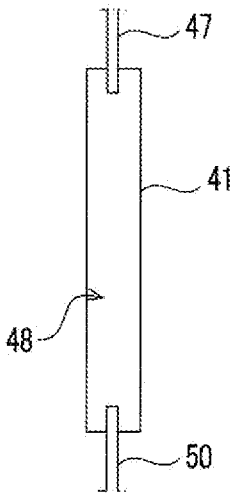
FIG. 9B is a schematic diagram showing a supporting structure of the bearing as viewed along an arrow 85 of FIG. 9A.

In the lower housing 22, as shown in FIG. 9, a supporting part 50 extended from a side below the bearing 41 to the bearing 41 is arranged. The supporting part 50 is formed in a curved shape. In the corresponding part in the lower housing 22 to the bearing 42, another supporting part similar to the supporting part 50 is arranged and the other supporting part is formed in a curved shape.

The bearing 41 is supported in a state put between the distal end 471 of the bent part 47 and the supporting part 50. In this time, a curvature center of the distal end 471 of the bent part 47 is matched with a center of the bearing 41. In addition, a curvature center of the supporting part 50 is matched with the center of the bearing 41. The bearing 42 is also supported similarly. That is, the bearing 42 is supported in a state put between the distal end 461 of the bent part 46 and the other supporting part. In this time, a curvature center of the distal end 461 of the bent part 46 is matched with a center of the bearing 42. In addition, a curvature center of the other supporting part is matched with the center of the bearing 42. Thus, the heating roller 11 is supported by putting the bearings 41, 42 between the bent parts 46, 47 of the supporting plate 23 and the supporting part 50 and others. The bent parts 46 and 47 are examples of a second protruding part of the present disclosure. The supporting part 50 and the other supporting part are examples of a third protruding part of the present disclosure.

The distal end 471 of the bent part 47 may be formed so as to curve at the same curvature as the outer circumference face 48 of the bearing 41. Moreover, the supporting part 50 also may be formed so as to curve at the same curvature as the outer circumference face 48 of the bearing 41. A part of the outer circumference face 48 (refer to FIG. 7) of the bearing 41 comes into contact with the distal end 471 of the bent part 47. A distal end of the supporting part 50 comes into contact with an opposite part R to a part Q, with which the distal end 471 of the bent part 47 comes into contact, across the center P of the bearing 41 in the outer circumference face 48 of the bearing 41. Similarly, the distal end 461 of the bent part 46 may be formed so as to curve at the same curvature as the outer circumference face 49 of the bearing 42. Moreover, the other supporting part also may be formed so as to curve at the same curvature as the outer circumference face 49 of the bearing 42. A part of the outer circumference face 49 (refer to FIG. 7) of the bearing 42 comes into contact with the distal end 461 of the bent part 46. A distal end of the other supporting part comes into contact with an opposite part to a part, with which the distal end 461 of the bent part 46 comes into contact, across the center of the bearing 42 in the outer circumference face 49 of the bearing 42.

Incidentally, as shown in FIG. 7, outside the bearing 42, a drive gear 45 is connected to the rotation shaft 44. Although the illustration is omitted in the figures, the drive gear 45 is meshed with another drive gear (not shown) connected to a motor shaft of a drive motor (not shown) to receive rotation drive force transmitted from the drive motor. The heating roller 11 is driven and rotated by the rotation drive force of the drive motor transmitted via the drive gear 45 and others. The pressuring roller 12 is come into pressure contact with the heating roller 11 by a pressure contact mechanism 56 mentioned below to co-rotate, in the embodiment, with rotation of the heating roller 11 by the pressure contact. As shown in FIG. 5, to an area in the upper housing 21 positioning outside the bent part 46 of the supporting plate 23, a space 150 is arranged and the drive gear 45 is stored in the space 150.

Figure 10:
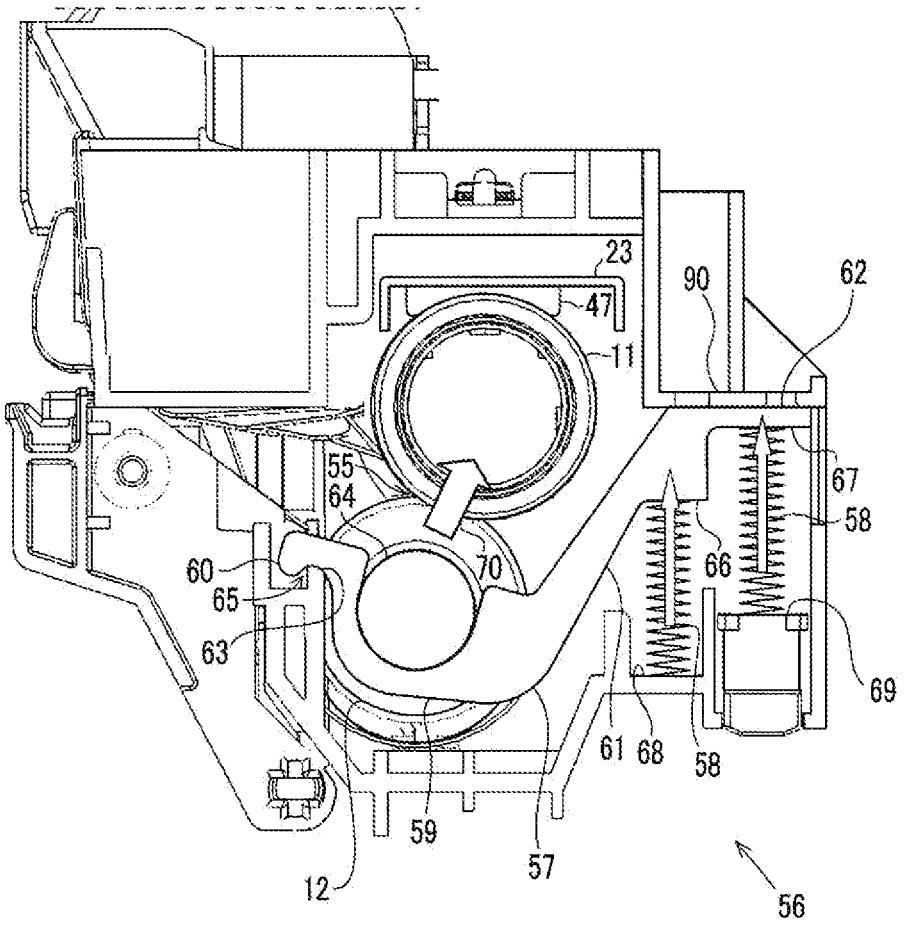
FIG. 10 is a sectional view showing a pressure contact mechanism, in which a pressuring roller comes into pressure contact with a heating roller.

As shown in FIG. 10, the fixing device 10 includes the pressure contact mechanism 56 forming a nip part 55 by making the pressuring roller 12 come into pressure contact with the heating roller 11. The pressure contact mechanism 56 includes a pressure contact lever 57 and coil springs 58. The pressure contact lever 57 has a bearing supporting part 59, an engaging part 60, an arm part 61 and a spring receiving part 62.

The bearing supporting part 59 is formed in a roughly U-shape. Into the bearing supporting part 59, a bearing 64 rotatably supporting a rotation shaft (nor shown) of the pressuring roller 12 is fitted and the bearing supporting part 59 supports the bearing 64 from a lower side. The engaging part 60 is formed so as to protrude from one end part of the bearing supporting part 59. The engaging part 60 has a recessed part 65 recessed upwardly so as to be hooked with the recessed part 65 to an engaged part 63 formed at a predetermined position in the lower housing 22 from an upper side. The arm part 61 is extended obliquely upward from another end part of the bearing supporting part 59 so as to separate from the engaging part 60.

The spring receiving part 62 is continued from an upper end part of the arm part 61. In a lower face of the spring receiving part 62, planar spring receiving faces 66 and 67 with different height positions from each other are formed. Among the spring receiving faces 66 and 67, the spring receiving face 66 near the pressuring roller 12 is formed to have the height position lower than the spring receiving face 67. Between a spring receiving face 68 formed in the lower housing 22 and the spring receiving face 66 in the spring receiving part 62 of the pressure contact lever 57, the coil spring 58 is arranged in a compressed state. Similarly, between a spring receiving face 69 formed in the lower housing 22 and the spring receiving face 67 in the spring receiving part 62 of the pressure contact lever 57, the coil spring 58 is arranged in a compressed state. An upper part of the spring receiving part 62 comes into contact with a predetermined part 90 of the lower housing 22 so that upward movement of the spring receiving part 62 is restricted. Thus, the spring receiving part 62 is biased upwardly by the coil springs 58. As a result, the bearing 64 rotatably supporting the rotation shaft (not shown) of the pressuring roller 12 and the pressuring roller 12 are biased upwardly. In this time, as indicated by an arrow 70, the pressuring roller 12 is come into pressure contact with the heating roller 11. Such a pressure contact mechanism 56 is provided so as to correspond to each end part of the heating roller 11 and pressuring roller 12.

By a bias force as mentioned above, the heating roller 11 receives a force in an upward direction from the pressuring roller 12. By this force, the above-mentioned bearings 41 and 42 rotatably supporting the rotation shafts 43 and 44 of the heating roller 11 is pressed to the bent part 46 and 47 of the supporting plate 23. Since the upper housing 21 comes into contact with the supporting plate 23 at a part in the upper housing 21 around the hole parts 27 and 28 formed in the supporting plate 23, this part receives the supporting plate 23. That is, the upper housing 21 holds the supporting plate 23.

In a conventional fixing device, a temperature detecting element, such as a thermistor or a thermal cut, was arranged in an inner wall face of an upper housing so as to face to a circumference face of a heating roller. Because such an upper housing is made of synthetic resins, the upper housing may be deformed by heat generated by the heating roller. When the upper housing is deformed, a distance between the temperature detecting element arranged in the upper housing and the circumference face of the heating roller is varied. In order to suitably control circumference face temperature of the heating roller, the distance between the temperature detecting element and heating roller is important. However, if the distance is varied as mentioned above, the circumference face temperature of the heating roller cannot correctly be detected. As a result, it is impossible to suitably control the circumference face temperature of the heating roller.

By contrast, in the embodiment, between the upper housing 21 and heating roller 11, the supporting plate 23 with high heat resisting property as compared with the upper housing 21 is arranged and the temperature detecting element is attached to the supporting plate 23. Thereby, as compared with a conventional structure attaching the temperature detecting element directly to the upper housing, the distance between the heating roller 11 and temperature detecting element is hardly varied. That is, it is possible to prevent the distance between the heating roller 11 and temperature detecting element from varying caused by the heat generated by the heating roller 11. As a result, it is possible to correctly detect the circumference face temperature of the heating roller 11 and to suitably control the circumference face temperature.

Moreover, unlike the conventional structure, since it is unnecessary to consider variation of the distance between the heating roller 11 and temperature detecting element caused by deformation of the upper housing 11, it is unnecessary to contain a distance adjusting process in manufacturing process of the fixing device 10 and it is possible to reduce man-hours.

In the embodiment, the supporting plate 23 is composed of the plate metal. Thereby, it is possible to facilitate creation of the supporting plate 23 with high heat resisting property as compared with the upper housing 21.

In the embodiment, by fitting positioning bosses 37 formed in the facing part 29 of the upper housing 21 into the hole parts 27 and 28 formed in the supporting plate 23, the positioning in the longitudinal direction of the supporting plate 23 to the upper housing 21 is determined. In addition, by an action of the pressure contact mechanism 56, the supporting plate 23 is pressed to the upper housing 21. By such pressing force and the positioning in the longitudinal direction, it is possible to hold the supporting plate 23 in the upper housing 21 without requiring attachment means, such as an adhesive or a screw, attaching the supporting plate 23 to the upper housing 21.

In the embodiment, the distal ends 461 and 471 of the bent parts 46 and 47 arranged at both ends of the supporting plate 23 are formed so as to curve at the same curvature as the outer circumference faces 48 and 49 of the bearings 41 and 42. Therefore, since the bearings 41 and 42 are closely fitted into the distal ends 461 and 471 of the bent parts 46 and 47, it is possible to avoid position displacement of the bearings 41 and 42 along a plane orthogonal to the longitudinal direction of the heating roller 11. As a result, it is possible to prevent or to restrain the distance between the heating roller 11 and temperature detecting element from varying.

In the embodiment, the supporting plate 23 comes into contact with the upper housing 21 at the periphery of the hole parts 27 and 28 and most of parts of the supporting plate 23 are arranged with space from the upper housing 21. Thereby, when temperature of the supporting plate 23 becomes high by the heat of the heating roller 11, the upper housing 21 is hardly affected by heat of the supporting plate 23 as compared with a structure that most of parts of the supporting plate 23 are in close contact with the upper housing 21. Therefore, it is possible to prevent or to restrain the upper housing 21 from deforming by heat.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a heating roller and a pressuring roller sandwiching and heating a sheet to fix a toner image formed on the sheet onto the sheet;

a first holding member having a facing part facing to a circumference face of the heating roller and a recessed part composed of the facing part to hold the heating roller;

a supporting member made of material with high heat resisting property as compared with the first holding member, arranged between the facing part of the first holding member and the circumference face of the heating roller and fitted into the recessed part so as to face to the circumference face of the heating roller, and formed in an elongated shape along an axial direction of the heating roller;

a temperature detecting part arranged in the supporting member to detect temperature of the heating roller; and bearings rotatably supporting rotation shafts arranged at both ends of the heating roller, wherein the supporting member includes, at both ends, second protruding parts supporting the bearings, the second protruding parts have end parts extending to sides of the bearings and the end parts of the second protruding parts are formed in curved shapes so that curvature centers are matched with centers of the bearings.

2. The fixing device according to claim 1, wherein the first holding member is made of synthetic resins, the supporting member is composed of a plate metal.

3. The fixing device according to claim 1, wherein the supporting member has a hole part at a predetermined position, the facing part of the first holding member has a first protruding part at a corresponding position to the hole part of the supporting member, positioning in the longitudinal direction of the supporting member to the first holding member is determined by fitting the first protruding part into the hole part.

4. The fixing device according to claim 1 further comprising:

a second holding member rotatably supporting the pressuring roller, wherein the first holding member supports the supporting member, the second holding member has a third protruding part extended to a side of the bearing, end parts of the third protruding part are formed in curved shapes so that curvature centers are matched with the centers of the bearings, the bearings are supported by the end parts of the second protruding part and the end parts of the third protruding part.

5. The fixing device according to claim 1 further comprising:

an excessive temperature rise preventing device including the temperature detecting part to cut off power supply to the heating roller when a detecting value of the temperature detecting part is a predetermined value or more, wherein excessive temperature rise preventing device is attached to the supporting member.

6. The fixing device according to claim 1, wherein the temperature detecting part is arranged in a face in the supporting member facing to the circumference face of the heating roller and composed of a thermistor detecting temperature of the circumference face of the heating roller in a noncontact state.

7. The fixing device according to claim 4 further comprising:

a pressure contact mechanism forming a nip part by making the pressuring roller come into pressure contact with the heating roller, wherein the heating roller receives a force from the pressuring roller by the pressure contact mechanism and, by this force, the bearing is pressed to the supporting member and the supporting member is held in the first holding member.

8. An image forming apparatus comprising:

the fixing device according to claim 1.

* * * * *